US006981301B2

(12) United States Patent
Medina et al.

(10) Patent No.: US 6,981,301 B2
(45) Date of Patent: Jan. 3, 2006

(54) DEVICE FOR INSTALLING A PRE-HUNG DOOR

(75) Inventors: Jose Medina, Royal Palm Beach, FL (US); Jason M. Smalling, Wellington, FL (US)

(73) Assignee: Widget Tools, LLC, North Miami Beach, FL (US)

( * ) Notice: Subject to any disclaimer, the term of this patent is extended or adjusted under 35 U.S.C. 154(b) by 0 days.

(21) Appl. No.: 10/863,430

(22) Filed: Jun. 8, 2004

(65) Prior Publication Data

US 2005/0268449 A1 Dec. 8, 2005

(51) Int. Cl.
*B25B 27/14* (2006.01)

(52) U.S. Cl. ..... 29/281.5; 29/559

(58) Field of Classification Search ..... 29/281.5, 29/281.1, 559; 269/111, 112, 905
See application file for complete search history.

(56) References Cited

U.S. PATENT DOCUMENTS

| | | | | |
|---|---|---|---|---|
| 773,176 | A | 10/1904 | Washington | |
| 1,168,147 | A * | 1/1916 | Bender | 249/48 |
| 1,257,200 | A | 2/1918 | Durkee | |
| 1,627,175 | A | 5/1927 | Hansen | |
| 1,778,496 | A | 10/1930 | Hobbs | |
| 2,502,166 | A | 3/1950 | McKay | |
| 2,679,696 | A | 6/1954 | Reeder | |
| 2,748,493 | A | 6/1956 | Williams | |
| 3,392,972 | A * | 7/1968 | Wing | 269/87.2 |
| 3,675,297 | A | 7/1972 | Appleton | |
| 5,167,073 | A | 12/1992 | Stein | |
| 5,365,697 | A | 11/1994 | Vanderpan | |
| 5,560,112 | A | 10/1996 | Stein et al. | |
| 6,209,859 | B1 * | 4/2001 | Chung | 269/111 |
| 6,237,233 | B1 | 5/2001 | Cloutier et al. | |
| 6,530,186 | B2 | 3/2003 | Torstensen | |
| 2004/0000061 | A1 | 1/2004 | Tuthill | |

* cited by examiner

*Primary Examiner*—Lee D. Wilson
(74) *Attorney, Agent, or Firm*—Jon A. Gibbons; Fleit, Kain, Gibbons, Gutman, Bongini & Bianco P.L.

(57) ABSTRACT

A device having a first, a second, a third, and a fourth slidably adjustable element arranged in a rectangular configuration, forming a rectangular pass-through opening approximately the size of a doorway and being slidably adjustable in a height dimension and a width dimension of the rectangle and having clamps for attaching the device to a doorframe so that the doorframe can be placed within a rough opening in a wall of a building while keeping a rectangular shape. The device has telescoping feet for adjusting the height off of the floor and leveling the frame. Once the frame is attached to the rough opening in the wall the clamps are released from the frame and the elements are contracted to allow the device to be removed from the frame, leaving the frame secured and properly aligned within the rough opening.

13 Claims, 15 Drawing Sheets

100

DEVICE FOR INSTALLING A PRE-HUNG DOOR

BACKGROUND OF THE INVENTION

1. Field of the Invention

This invention relates in general to installing pre-hung doors and more particularly, to a device that properly aligns and shapes a pre-hung doorframe during installation within a rough opening in a wall.

2. Description of the Related Art

In building construction, in which doors are to be installed, the building contractors leave rough openings in the walls where finish carpenters, according to the architectural plans for the building, will later install the doorframes and doors. Doorframes generally consist of a head jamb spanning the distance between two side jambs and must be installed so that the jambs are completely plumb, or vertical, the head jamb is horizontal, the entire frame is square, and all parts of the frame are in the same plane. The jambs are secured in place with nails or screws to studs forming the rough opening in the wall. Once the frame is secured to the rough opening, a door or set of doors are then attached to the frame. However, the frame material is relatively thin and the four corners, where the rectangularly arranged sections meet and are attached to each other, do not present a great deal of surface area for bonding. Therefore, the frame is prone to twisting, warping, bending, and separating during the installation stage. If the frame is not completely square, the door will not swing true and will not close properly. This can result in gaps between the door and the frame, the doors hitting the frame or floor, or not closing properly.

Pre-hung doors are well known by those in the art. Pre-hung doors are factory-manufactured doors, which include a door attached by hinges to a preassembled jamb. One technique of installing the pre-hung door and frame in a proper alignment is to place the door in the rough opening, which will be larger than the frame, center it in the frame, use a level on the jambs to ensure proper alignment, place shims between the jambs and the studs to properly space each end of the jamb from the studs to achieve vertical or horizontal alignment, and then screw or nail the frame to the shims and, in turn, the shims to the studs. This method is difficult and time consuming even for a skilled carpenter. To achieve any level of efficiency, this method requires two carpenters, one to hold the level and the jamb and the other to install the shims and screw the frame to the studs. Additionally, this method does not ensure that the frame is installed in a single plane.

Several prior-art devices have been introduced to improve upon the above-described process. One such device is Tuthill (U.S. Pat. Pub. No. 2004/0000061 A1), which discloses an apparatus for installing a frame and related appurtenances incorporating four corner members slidably and releasably joined with height and width adjusters. The Tuthill apparatus is placed within a preassembled doorframe and then placed within a rough opening in a wall. The apparatus keeps the frame square while it is shimmed and secured to the wall. The Tuthill apparatus, however, suffers from the disadvantage of only securing the frame to the apparatus in one direction with a frame member 110, allowing a section of the frame to slide out of skew during installation. Additionally, the floor of the building may not be perfectly level, however, the door must be. Therefore, the height from the floor to each side of the bottom of the frame will need to be set before securing the frame in the rough opening. The distance from the floor to the apparatus in Tuthill is constant and is set by the dimension of a strike side base frame section 144. If the floor is not level, the frame tilt will follow the floor.

Finally, the Tuthill apparatus has a horizontal adjustable brace 270. The presence of the brace prevents a worker from passing through the doorway opening during the installation process. This presents a difficulty to the carpenter who may need to work from both sides of the doorway to install the frame. It also prevents other workers from being able to pass through the opening while the device is in place, possibly slowing progress on other areas of the building. Other prior art doorframe-hanging devices that suffer from this same disadvantage are: Washington (U.S. Pat. No. 773,176), Durkee (U.S. Pat. No. 1,257,2000), Hansen Jr. (U.S. Pat. No. 1,627,175), Hobbs (U.S. Pat. No. 1,778,496), Reeder Jr. (U.S. Pat. No. 2,679,696), Williams (U.S. Pat. No. 2,748,493), Appleton (U.S. Pat. No. 3,675,297), Stein (U.S. Pat. No. 5,167,073), and Stein et al. (U.S. Pat. No. 5,560,112).

Another prior art device is disclosed in Cloutier et al. (U.S. Pat. No. 6,237,233), which shows a doorframe adjustment apparatus that is horizontally collapsible. The Cloutier et al. device also suffers from some of the same disadvantages as does the Tuthill device. First, there are no clamping members to secure the frame to the device and preventing it from sliding relative to the edges of the device. As can be seen in FIG. 4 of Cloutier et al., members 2 and 3 may prevent movement of the frame in a first direction, toward the members, but nothing prevents the frame from sliding in a second direction away from the members 2 and 3. Secondly, the device does not provide a means for adjusting the height of the device, and therefore the frame, from the floor surface. Additionally, the Cloutier et al. device suffers from the disadvantage that it is not vertically collapsible and is therefore difficult to move, store, and remove from the door opening after the frame is secured. Finally, because the device is fixed in the vertical dimension, it cannot accommodate doors of varying size. This particular disadvantage is shared by the doorframe-hanging devices disclosed in Torstensen (U.S. Pat. No. 6,530,186) and McKay (U.S. Pat. No. 2,502,166).

Accordingly, a need exists for a construction tool for installing pre-hung doors that is adjustable in length and width to accommodate doors of varying dimensions and is capable of securely holding and properly aligning a doorframe during installation in a rough opening in a wall, while at the same time, allowing a worker to pass through the doorway opening.

SUMMARY OF THE INVENTION

Briefly, in accordance with the present invention, disclosed is a device for securely holding a pre-hung doorframe in a rough opening of a wall so that the frame can be properly secured to the wall in a straight and plumb alignment. The device includes four slidably adjustable elements arranged in a rectangular shape. Each element has a separation line near its center. A plate spans the separation line and has a groove along its length. Two bolts, one on either side of the separation line, extend in a direction toward the inner area of the rectangle and ride inside the groove in the plate when the elements are separated at the separation line. In this way, the rectangle can be increased or decreased in both width and length. Nuts on the ends of the bolts can be tightened to secure the elements in a particular position.

The device is placed inside a pre-hung doorframe and slidably adjusted to meet the inner dimensions of the frame. The device has pairs of clamps along its elements which are used to attach and secure the frame to the device so that the device and frame can be placed within a rough opening in a wall and the frame will retain the rectangular shape of the device without being able to distort. The clamps can be used to attach the device and frame to the edges of the rough opening of the wall to further facilitate alignment of the frame with the wall. Advantageously, the device is rectangularly shaped and is completely open within its center, allowing workers to pass unencumbered through the doorway when the device is in place.

The frame, still attached to the device, is then leveled within the rough opening. A pair of telescoping feet attached to the base of the device allow the frame to be spaced from the floor surface and tilted to ensure proper leveling within the rough opening. Once the frame is level, shims are placed at various locations between the outside surface of the frame and an inside surface of the rough opening in the wall to provide proper contact with the opening. The device is provided with pass-through holes so that a screw or nail can be inserted into the frame, the shims, and finally the inside surface of the rough opening in the wall, to secure the frame in its properly aligned location.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and to explain various principles and advantages, all in accordance with the present invention.

DETAILED DESCRIPTION OF THE PREFERRED EMBODIMENT

Figure 1:
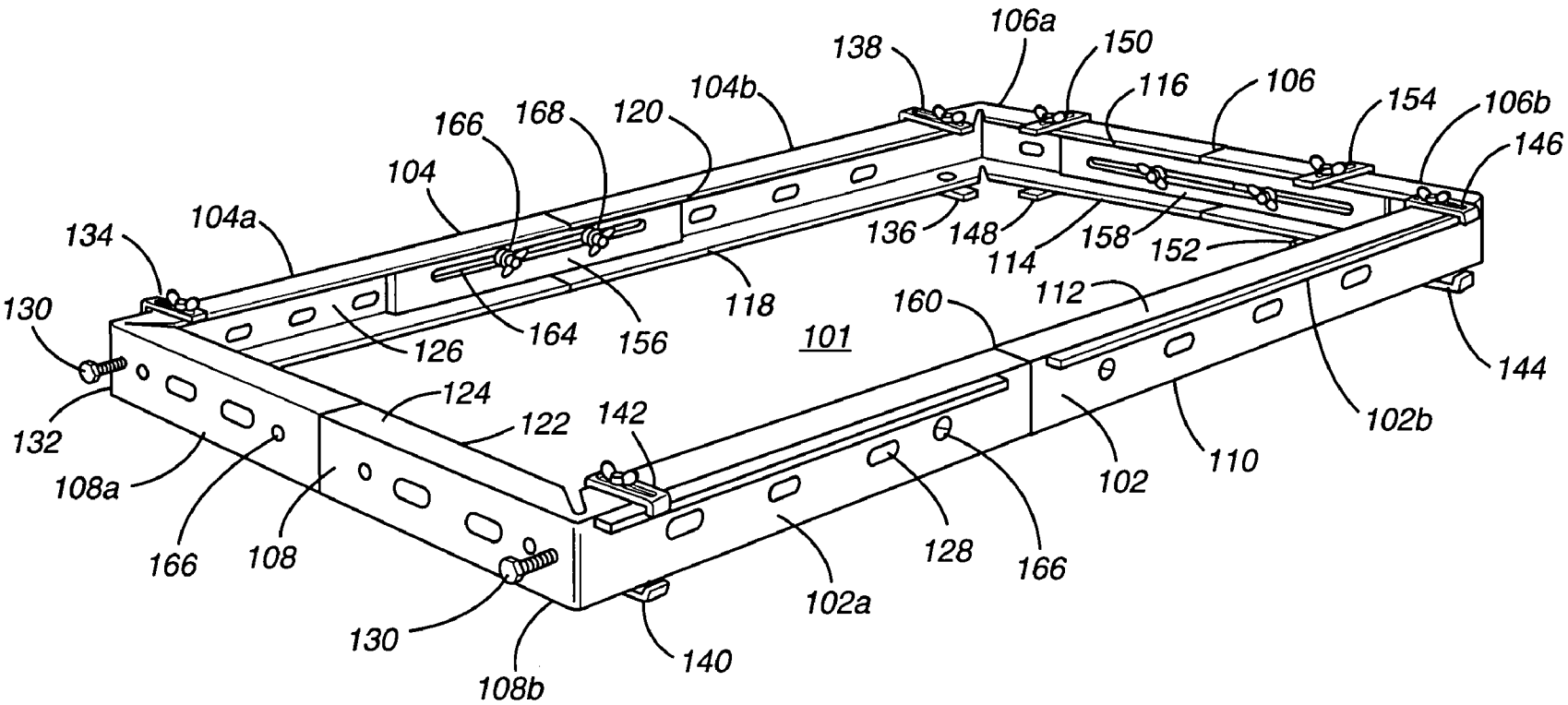
FIG. 1 is a diagram illustrating one embodiment of a doorframe-hanging device.

While the specification concludes with claims defining the features of the invention that are regarded as novel, it is believed that the invention will be better understood from a consideration of the following description in conjunction with the drawing figures, in which like reference numerals are carried forward.

Described now is an exemplary door installation device according to an exemplary embodiment of the present invention. Referring to FIG. 1, a door installation device 100 is shown in a horizontal position. The door installation device 100 includes a first side element 102, a second side element 104, a top element 106, and a bottom element 108. The elements 102, 104, 106, and 108 are attached to each other in a rectangular arrangement, where each element meets the other at a 90-degree angle. The elements 102, 104, 106, and 108 each have inwardly disposed wall elements 110, 112, 114, 116, 118, 120, 122, and 124. The sets of inwardly disposed wall elements 110 & 112; 114 & 116; 118 & 120 and 122 & 124 form an inwardly facing U-shaped channel 126. The direction "inwardly" refers to a direction towards central region 101 of the frame 100.

Each element 102, 104, 106, and 108 is provided with a plurality of cutouts 128, which are of proper dimension to, as will be explained later, allow a standard size screw or nail to pass through the element. The bottom element 108 includes a pair of telescoping feet 130 for leveling the device 100, which will also be explained in the proceeding paragraphs. The side elements 102 and 104 and the top element 106 are provided with laterally opposing clamping pairs 132 & 134, 136 & 138, 140 & 142, 144 & 146, 148 & 150, and 152 & 154 attached to their inwardly disposed wall elements 118 & 120, 110 & 112, and 114 & 116, respectively, and extending outwardly beyond the elements 102, 104, and 106. The direction "outwardly" refers to a direction away from central region 101 of the frame 100.

Each element 102, 104, 106, and 108 is formed of two slidably adjustable adjacent pieces 102*a*, 102*b*, 104*a*, 104*b*, 106*a*, 106*b*, and 108*a*, 108*b*, respectively. The adjacent pieces are connected by a plate 156, 158, which can be seen in FIG. 1 and 160, 162, which cannot be seen in FIG. 1, but are functionally the same as 156 and 158. Each plate is provided with a linear groove 164, which contains a pair of inwardly extending members 166, such as a screw or bolt, and at least one member is attached to each adjacent piece 102*a*, 102*b*, 104*a*, 104*b*, 106*a*, 106*b*, and 108*a*, 108*b*, as can be seen in FIG. 1. The plates 156, 158, 160, and 162 are secured in a particular position by lockdown nuts 168.

Figure 2:
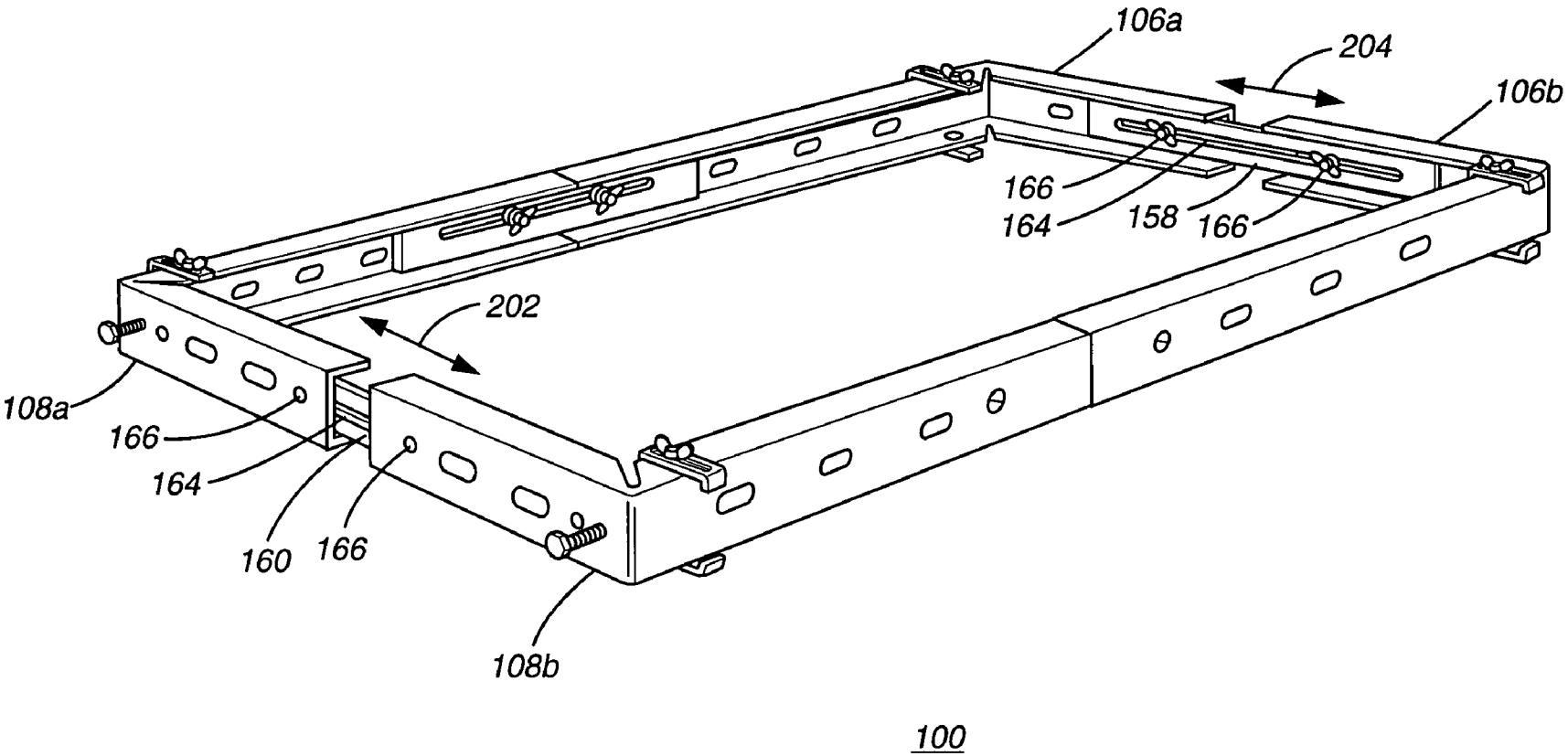
FIG. 2 is a diagram illustrating a width expansion feature of a doorframe-hanging device.
Figure 3:
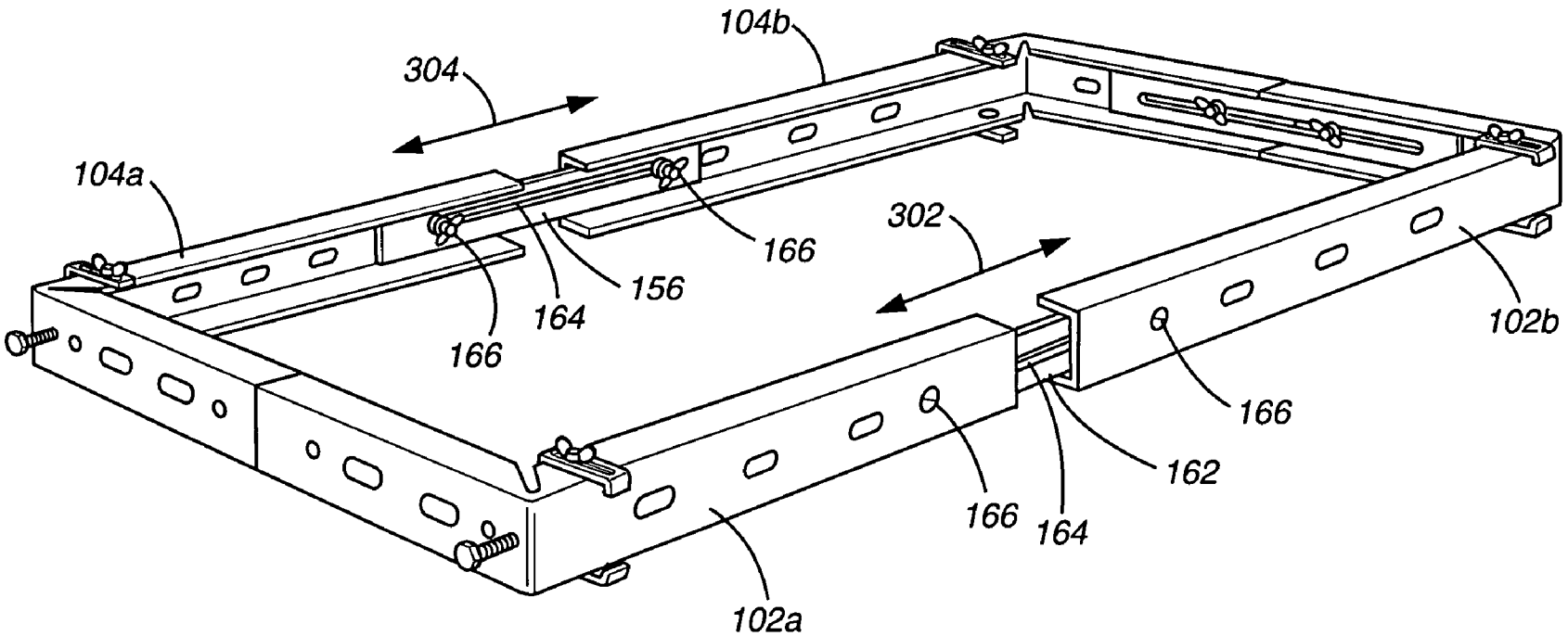
FIG. 3 is a diagram illustrating a length expansion feature of a doorframe-hanging device.

Referring now to FIG. 2, it can be seen how plates 158 and 160 allow the inwardly extending members 166 to slide with the groove 164 in plates 158 and 160 and allow the adjacent pieces 106*a*, 106*b*, and 108*a*, 108*b* to separate and increase the overall width of the device 100. Arrows 202 and 204 indicate the direction of movement. In a similar manner, FIG. 3 shows how inwardly extending members 166 slide within groove 164 in plates 156 and 162 to allow adjacent pieces 102*a*, 102*b*, and 104*a* and 104*b* to separate and increase the overall length of the device 100. Arrows 302 and 304 indicate the direction of movement. In FIGS. 2 and 3 is can be seen how the overall length and width of the device 100 can easily be increased or decrease to accommodate a variety of frame sizes and for easy removal from a door opening, which will be explained in detail in the proceeding paragraphs. The invention is not limited to use of a plate to adjust the length or width and many other methods of adjusting the length or width of the device 100 can be used to achieve the same results.

Figure 4:
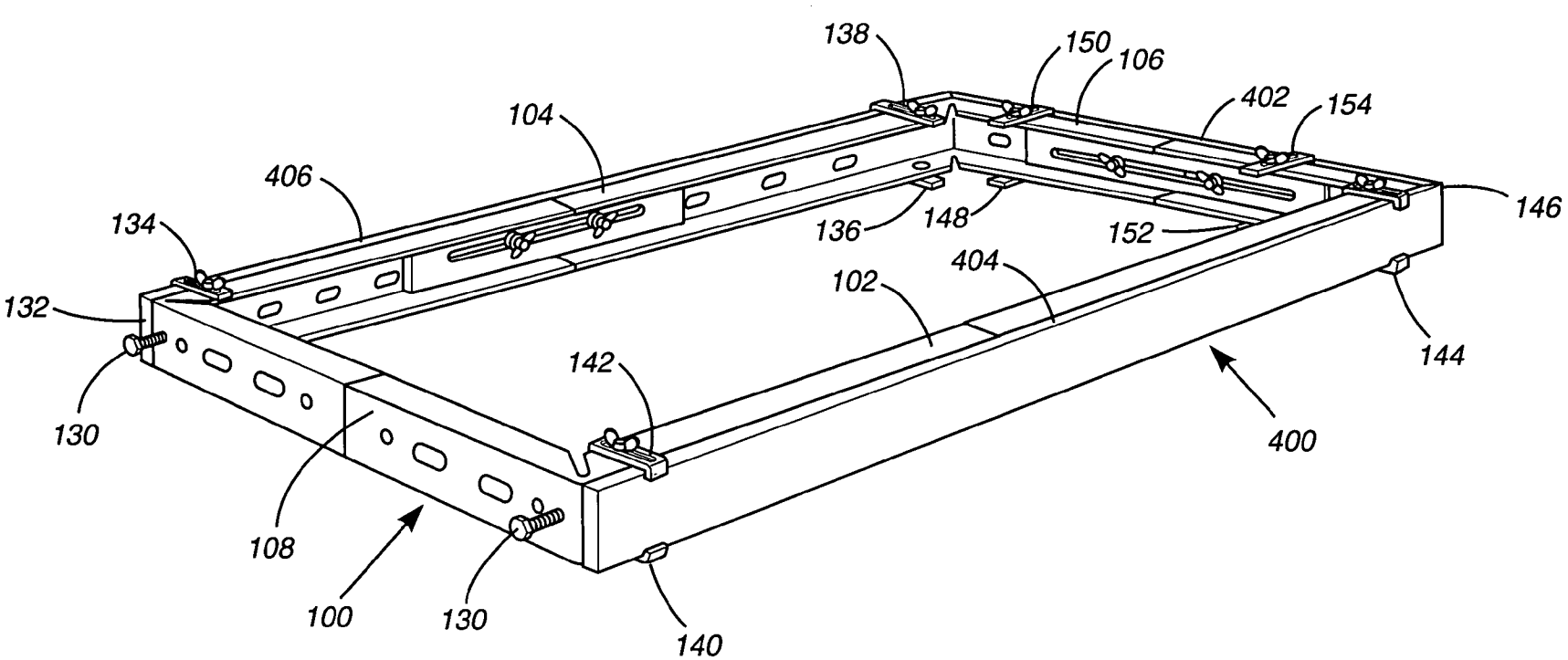
FIG. 4 is a diagram illustrating a doorframe-hanging device attached to a doorframe.
Figure 12:
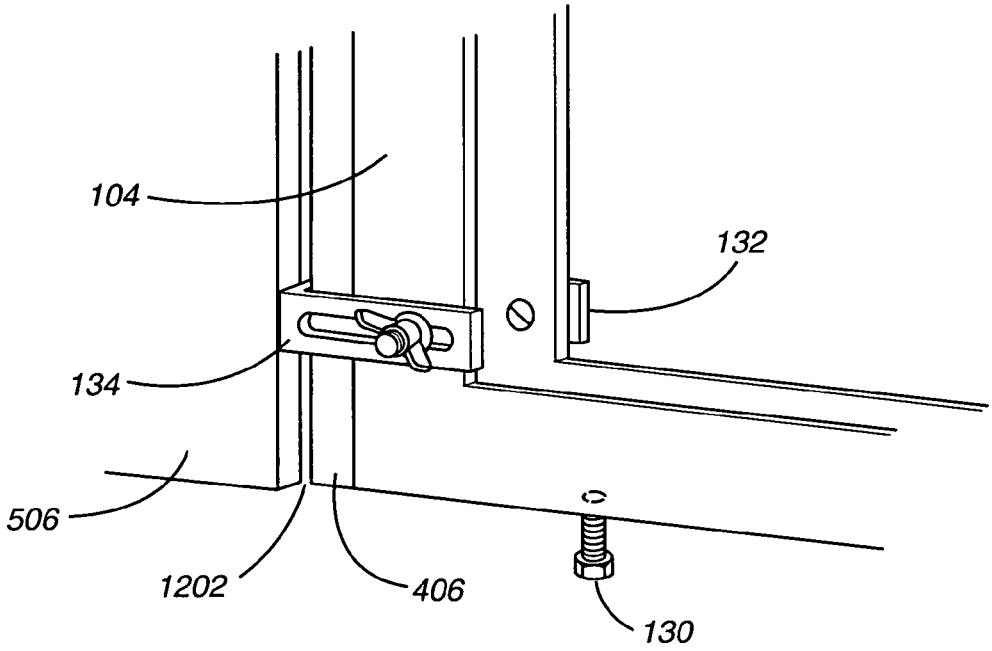
FIG. 12 is a diagram illustrating a close-up view of a section of a doorframe-hanging device, including a clamping pair, doorframe, and adjustable foot.

Referring now to FIG. 4, a doorframe 400 having a top 402, a first side 404, and a second side 406 is placed around the device 100 and secured to the device 100. As explained in the previous paragraph, the dimensions of device 100 can be adjusted to fit within a variety of frame sizes, both standard and custom, for single or double doors. Once the device 100 is properly sized to fit within and against the frame 400, clamping pairs 140 & 142, and 144 & 146 located on the first element 102, clamping pairs 132 & 134, and 136 & 138 on the second element 104, and clamping pairs 148 & 150, and 152 & 154 on the top element 106 are utilized to secure the frame tightly and securely against the device 100. A close-up view of a clamp 134 securing a portion 406 of frame 400 to element 104 is shown in FIG. 12. The clamp 134 has an L-shaped leg at one end and, used in conjunction with the device 100, constrains the frame from moving. An opposing clamp 132 on the opposite side of element 104 additionally prevents the frame from moving away from element 104.

Figure 5:
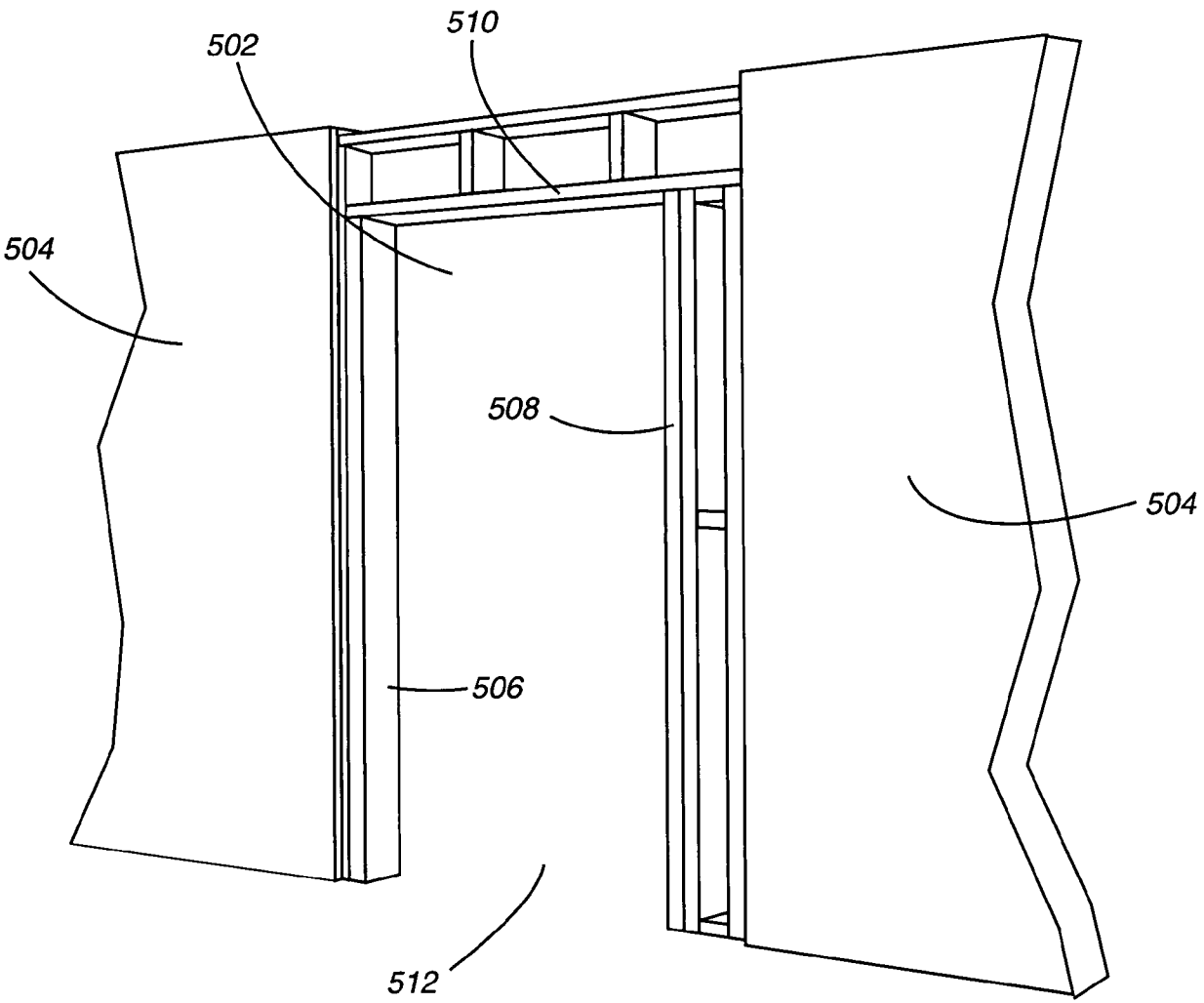
FIG. 5 is a diagram illustrating a rough opening in a wall.

FIG. 5 shows a rough opening 502 in a wall 504 of a building, which includes vertical studs 506 and 508 and a header 510. It is within the rough opening 502 that a pre-hung door is to be installed. However, to allow for material and workmanship tolerances, the studs 506 and 508 and header 510 are fixed so as to create an opening that is larger than the expected maximum dimensions of the doorframe 400. Additionally, due to defects in material, such as warping or twisting, or workmanship defects, the studs 506 and 508 may not be plum and the floor 512 and/or header 510 may not be completely level. If these defects are not compensated for, the door will not close properly. Therefore, the frame must be attached in and to the rough opening 502 so that the frame is secure, not distorted from its rectangular alignment, and within a single plane.

Figure 6:
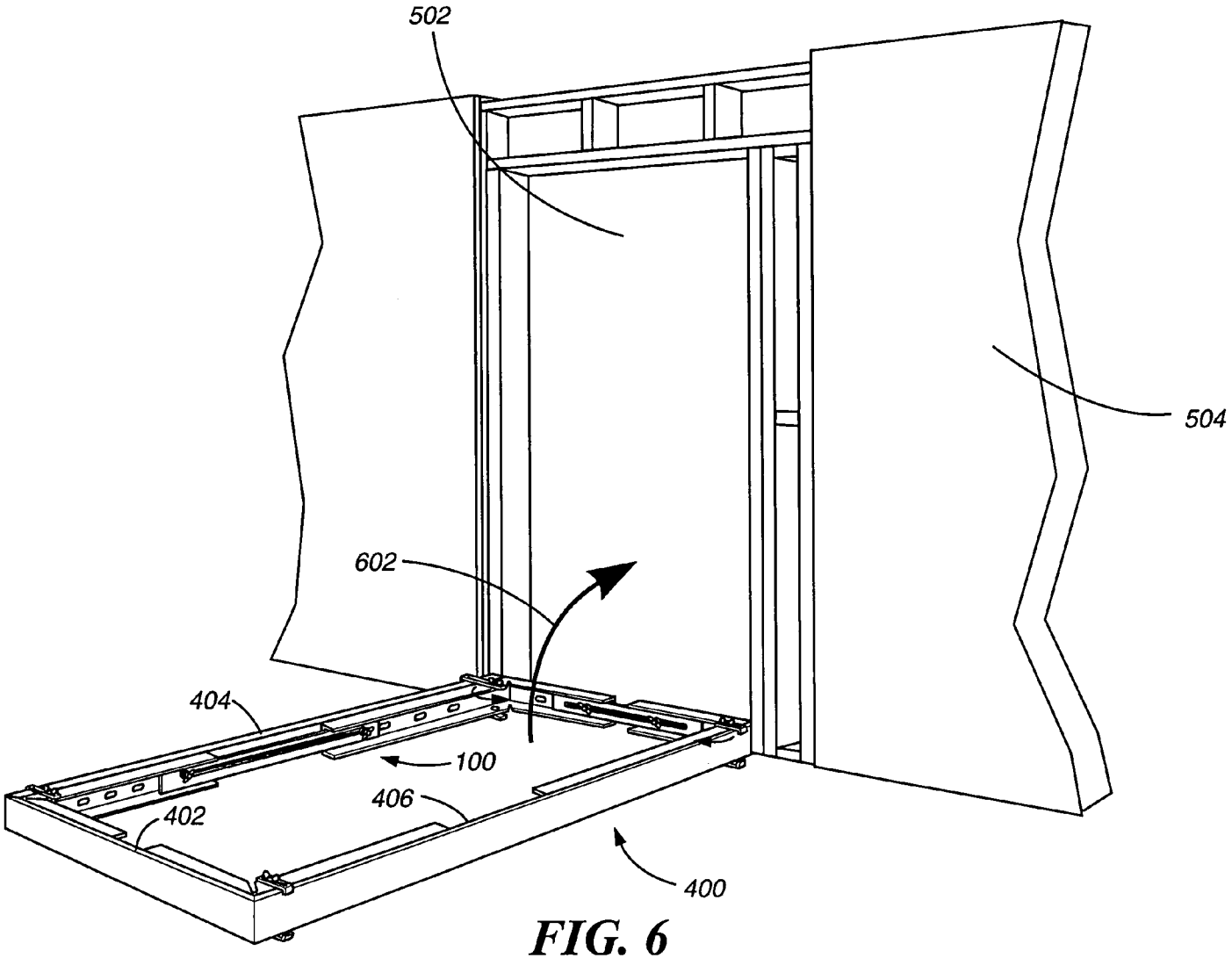
FIG. 6 is a diagram illustrating a doorframe-hanging device attached to a doorframe and partially inserted into a rough opening in a wall.

Referring now to FIG. 6, the device 100 can be seen expanded to fit snuggly against an inner surfaces of a frame 400. The device is in the horizontal position shown in FIG. 1, with the exception of being rotated 180 degrees, so that the telescoping feet 170 cannot be seen in FIG. 6. The device 100 is securely attached to the frame 400 via clamp sets 132 & 134, 136 & 138, 140 & 142, 144 & 146, 148 & 150, and 152 & 154. The device 100 is preferably constructed of a rigid material, such as metal, plastic, composite, or other similar materials, so that the frame 400 and device 100 can be moved and positioned without distorting frame 400 from its rectangular configuration (90-degree angled corners) within a single plane with straight edges 402, 404, and 406. Arrow 602 illustrates the movement of the device 100 and frame 400 to fit within the opening 502.

Figure 7:
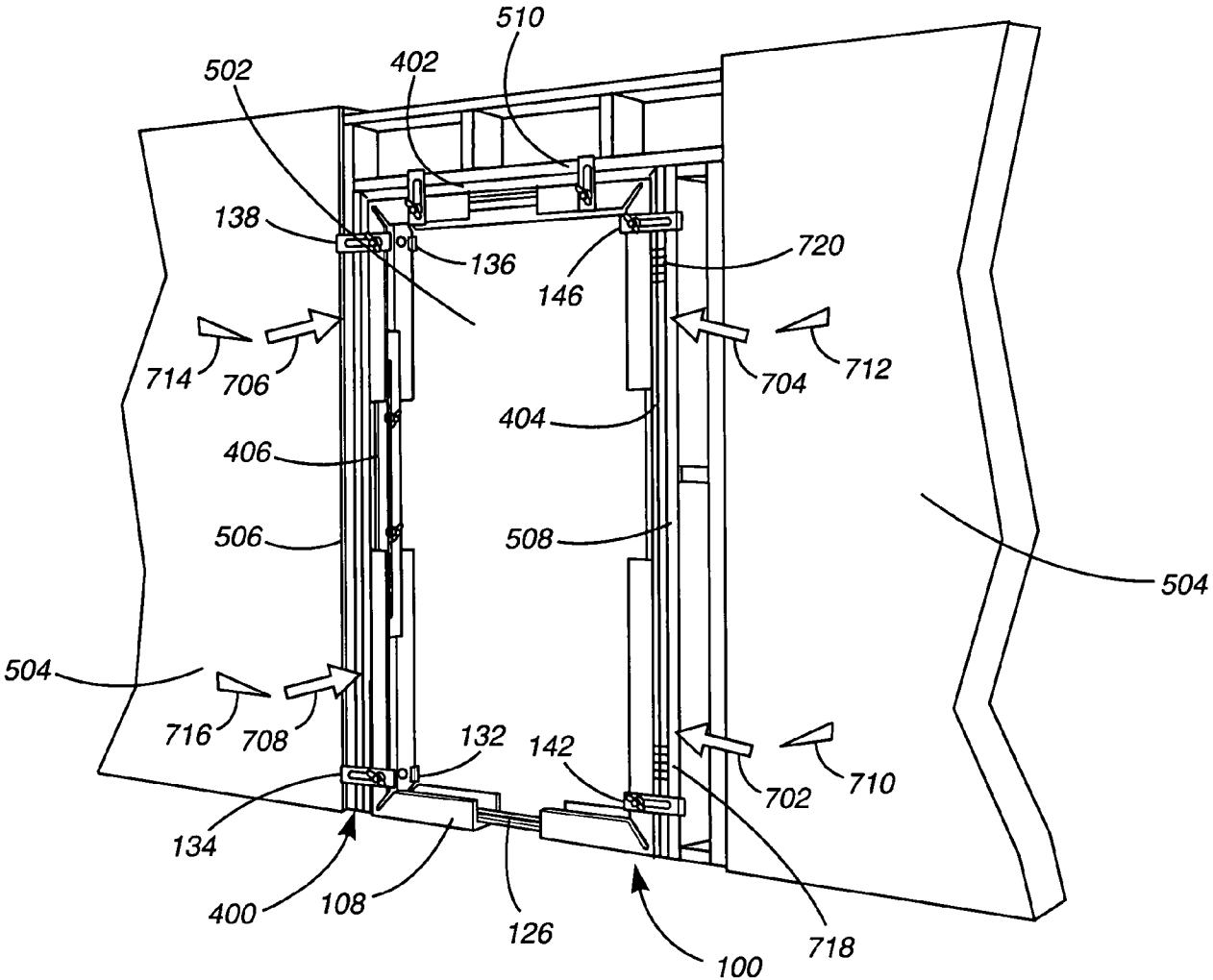
FIG. 7 is a diagram illustrating a doorframe-hanging device attached to a doorframe and fully inserted into a rough opening in a wall.

FIG. 7 shows the device 100 and frame 400 positioned within the rough opening 502. Once in position, a level (not shown) can be placed inside the U-shaped channel 126 of the bottom element 108. The adjustable members 130 (not shown) can be telescoped in and out to level the device 100 and frame 400. The members 130 can also be utilized to space the frame 400 off of the floor surface a proper distance. Additionally, a level (not shown) can be used along the first element 102 or second element 104 to ensure that the frame 400 is plumb, or vertical, before attaching the frame 400 to the rough opening 502. As previously mentioned, the rough opening 502, formed by studs 506 and 508, header 510 and floor 512, is slightly larger than the outer dimension of the frame 400.

As is also shown in FIG. 7, the clamping pairs 140 & 142, and 144 & 146 located on the first element 102 and the clamping pairs 132 & 134, and 136 & 138 on the second element 104 can be extended to clamp onto the studs 506 and 508 to secure the device in the plane of the opening 502 in the wall 504. It is noted that this method cannot be used if the walls are finished, meaning the studs are covered with drywall material. A second method, described later, may be employed in this situation.

FIG. 7 diagrammatically illustrates via arrows 702, 704, 706, and 708 where shims 710, 712, 714, and 716 may be placed in order to plum and level doorframe 400 in the rough opening 502. Once the shims 710, 712, 714, and 716 are in the proper location, nails or screws can be driven via cutouts 128 (not shown) through the frame 400, through the shims 710, 712, 714, and 716, and into the studs 506 and 508 to secure the frame 400 within the opening 502. Also shown in FIG. 7 are two hinges 718 and 720, which are attached to the frame section 406. For the method of installing the doorframe, so far described and shown in the drawings, the pre-hung door (not shown) has been separated from the frame 400 by removing a pin (not shown) from the hinges 718 and 720. Once the frame is in place, as will be described below, the door can easily be reattached to the hinges 718 and 720. If a set of double doors is to be installed in the doorway 502, a second set of hinges can simply be provided on the opposite side 406 of the doorframe 400.

Figure 8:
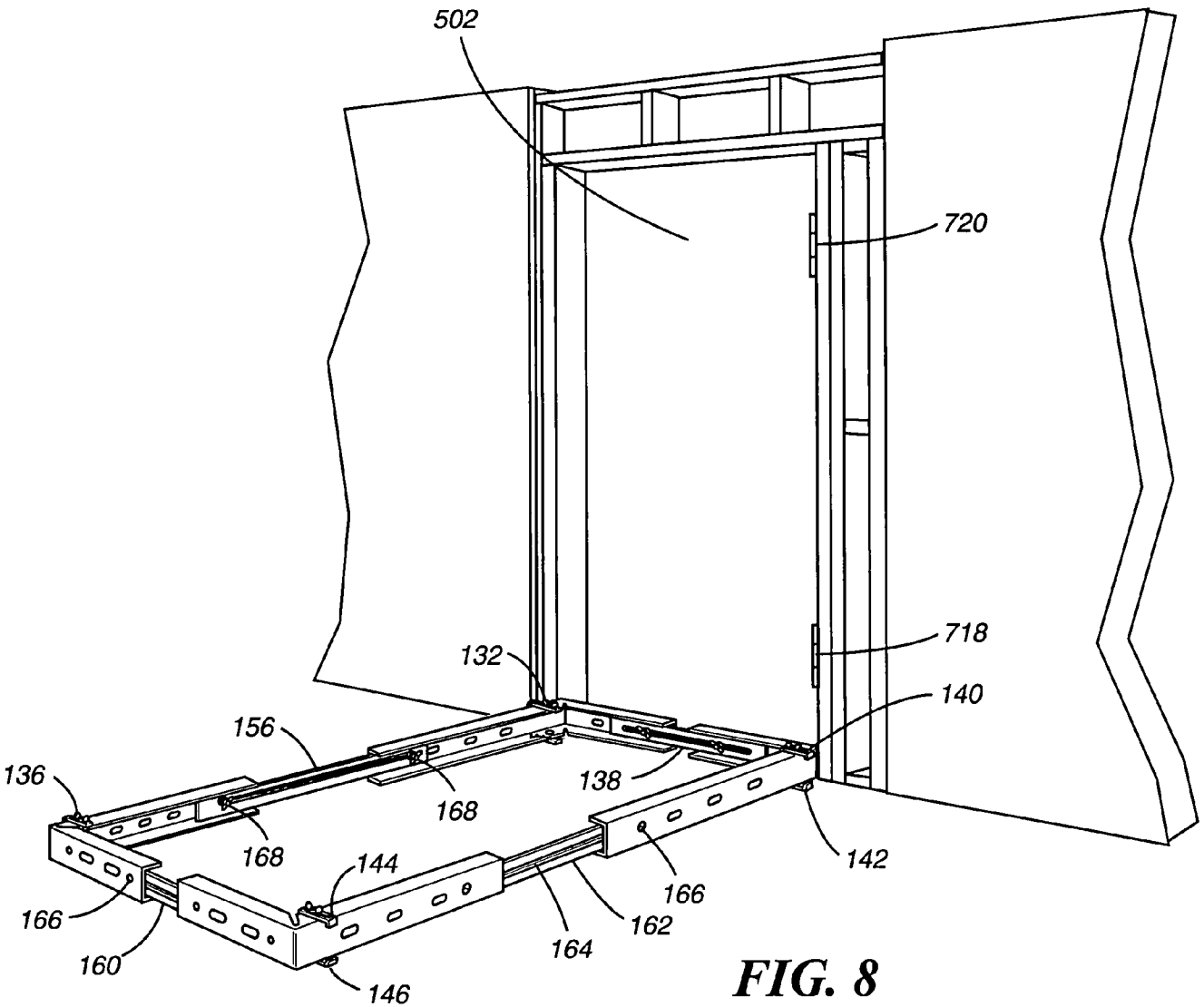
FIG. 8 is a diagram illustrating a doorframe-hanging device removed from a doorframe and a rough opening in the wall.

Referring now to FIG. 8, after the frame 400 is properly and permanently secured to the opening 502, the device 100 can then be removed. The removal of the device 100 begins with the clamping pairs 132, 134, 136, 138, 140, 142, 144, 146, 148, 150, 152, and 154 being released from the edges 402, 404, 406 of the frame 400 and/or the studs 506 and 508. Once the device 100 is no longer attached to the frame 400 via the clamping pairs 132, 134, 136, 138, 140, 142, 144, 146, 148, 150, 152, and 154, the locking nuts 168 are loosened so the extending members 166 can slide toward one another within the groove 164 in the plates 156, 158, 160, 162. This allows the device 100 to shrink in size and easily slide out of the opening in the doorway 502, as is shown in FIG. 8.

A level doorframe 400 is now installed in a rough opening 502 of a building. A door, or doors, can now be attached to hinges 718 and 720 attached to the frame 400, and the door(s) will swing true and properly close within the frame.

As described above, pre-hung doors come from the factory as a door mounted to an assembled doorframe 400. In the methods described above, the doorframe 400 is mounted by removing the door from the frame 400 during installation and then reattaching the door once the frame 400 is mounted. However, a timesavings can be realized if the frame can be installed without having to remove the door. To mount the frame 400, the door must be in an open position during the installation, which adds a large weight to one side of the frame. One difficulty realized in the prior art is that the weight of the door causes the frame to tilt in the direction of the open door. This problem is overcome by the embodiment shown in FIG. 9.

Figure 9:
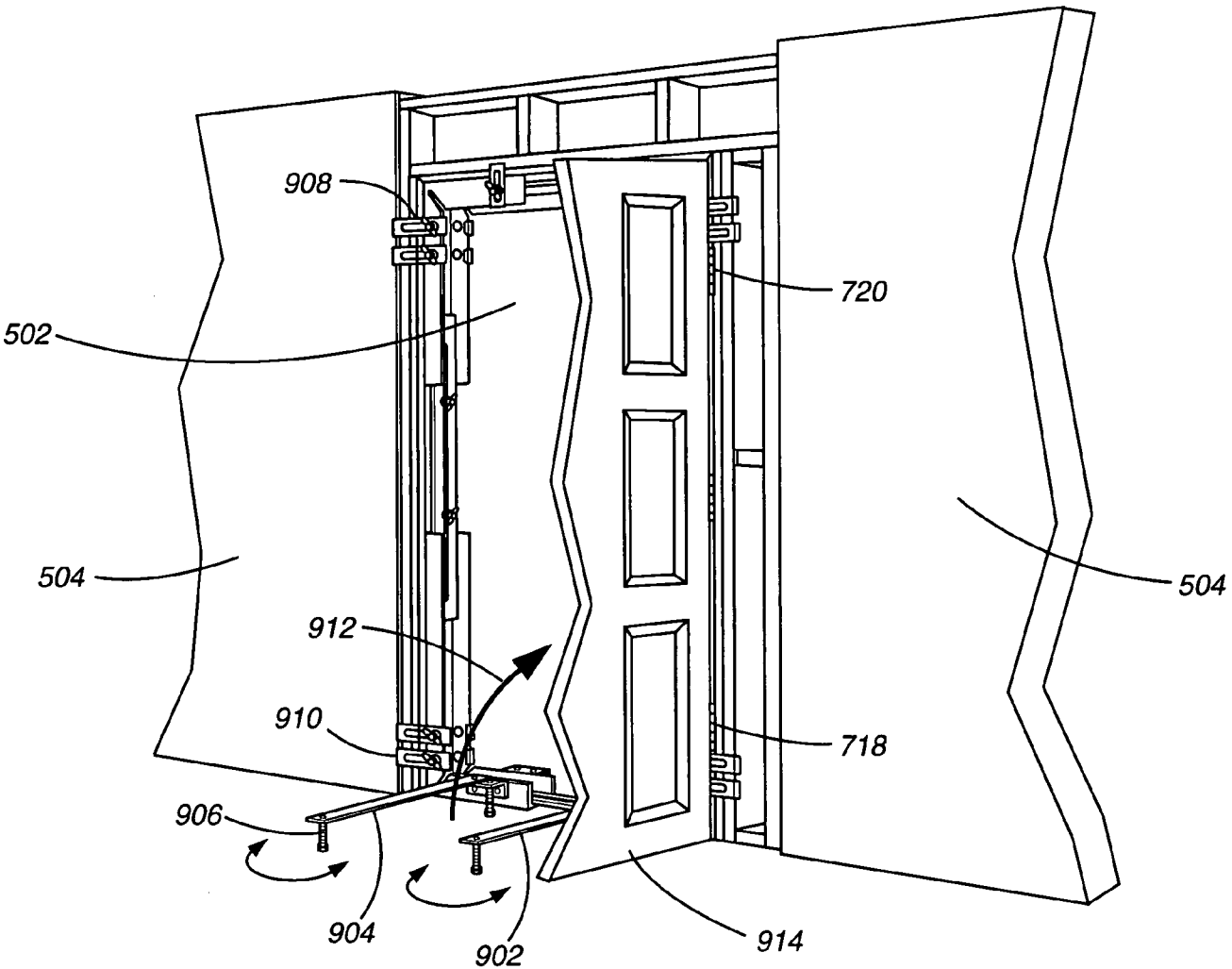
FIG. 9 is a diagram illustrating an embodiment of a doorframe-hanging device attached to a doorframe including a door and inserted into a rough opening in a wall.

In FIG. 9, a pair of foldable lever arms 902 and 904 are shown attached to the bottom element 108 of device 100. Each of the foldable lever arms 902 and 904 is provided with a telescoping foot 906 at an end furthest away from the device 100. The foldable lever arms 902 and 904 and the feet 906 are provided to assist in leveling the frame 400 with a wall 504 in a rough opening 502 in a building and counteract the weight of the door 914 attached to the frame 400 by hinges 718 and 720. For proper installation and for the door to function properly once installed, the upper 908 and lower 910 portions of the frame 400 must be in the same plane as the wall 504. By adjusting the telescoping feet 906, the upper portion of the device 100 and frame 400 is adjusted, as shown by direction arrow 912, to be plumb, and/or in a shared plane with the wall 504.

Figure 13:
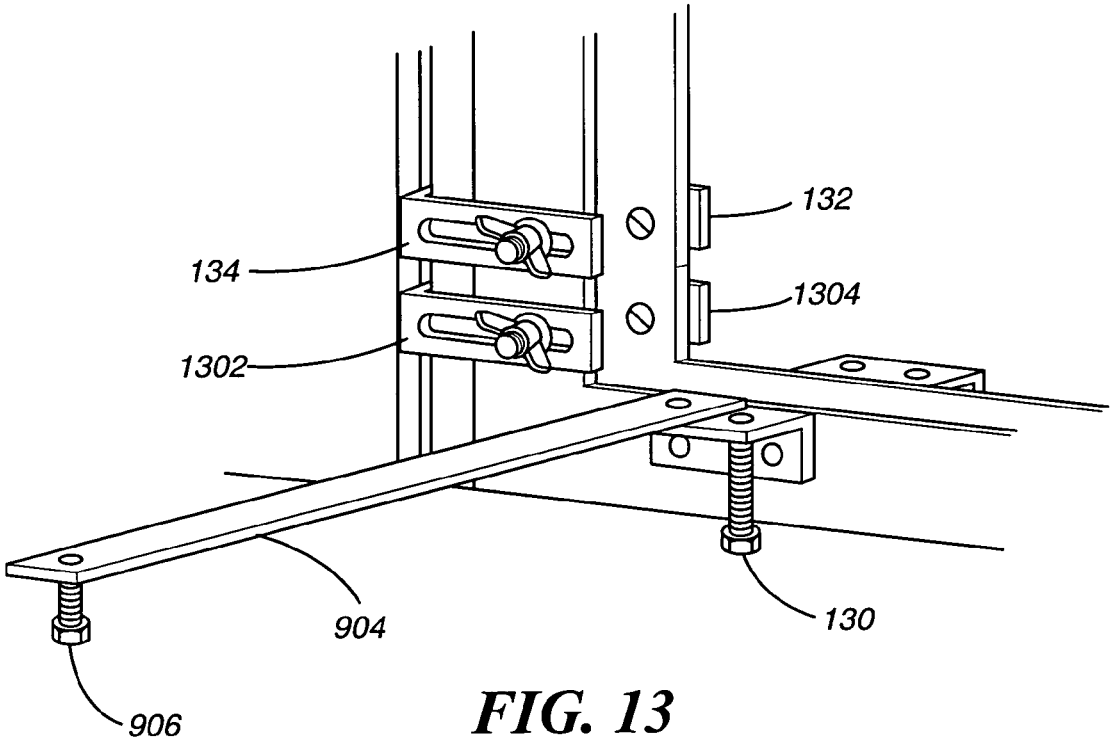
FIG. 13 is a diagram illustrating a close-up view of a section of a doorframe-hanging device, including a clamping pair, a second clamping pair, doorframe, adjustable foot, and lever-arm assembly.

A closer view of a telescoping member 130 and a clamping pair 134 and 132 can be seen in FIG. 12. A close-up view of a foldable lever arm 904, telescoping members 130 and 906, and clamping pair 132 and 134 are diagrammatically shown in FIG. 13. An additional clamping pair 1302 and 1304 is also shown in FIG. 13. The additional clamping pair 1302 and 1304 can be used to increase support of the frame 400, or can be used, as shown in FIG. 7, to attach the device 100 to the studs 506 and 508, or as will be described in the proceeding paragraph to attach to the wall 504.

Figure 10:
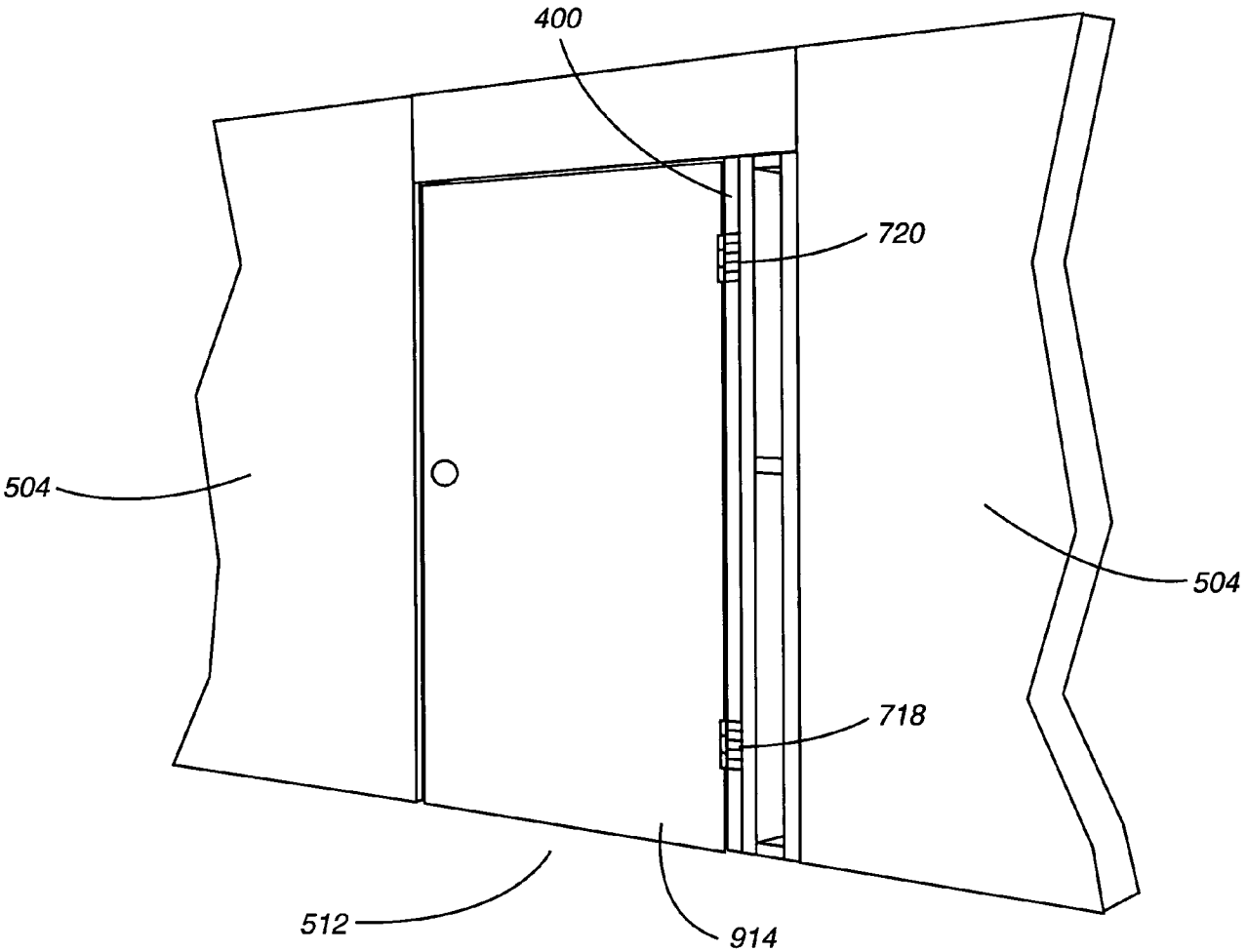
FIG. 10 is a diagram illustrating a single door and frame mounted in a rough opening in a wall.

FIG. 10 shows a complete installation of a single door 914 in wall 504. If properly aligned, the door 914 will have an even spacing between the wall 504 and both sides and the top of the door 914. Additionally, the door 504 can be opened without the door 914 scraping the floor 512.

Figure 11:
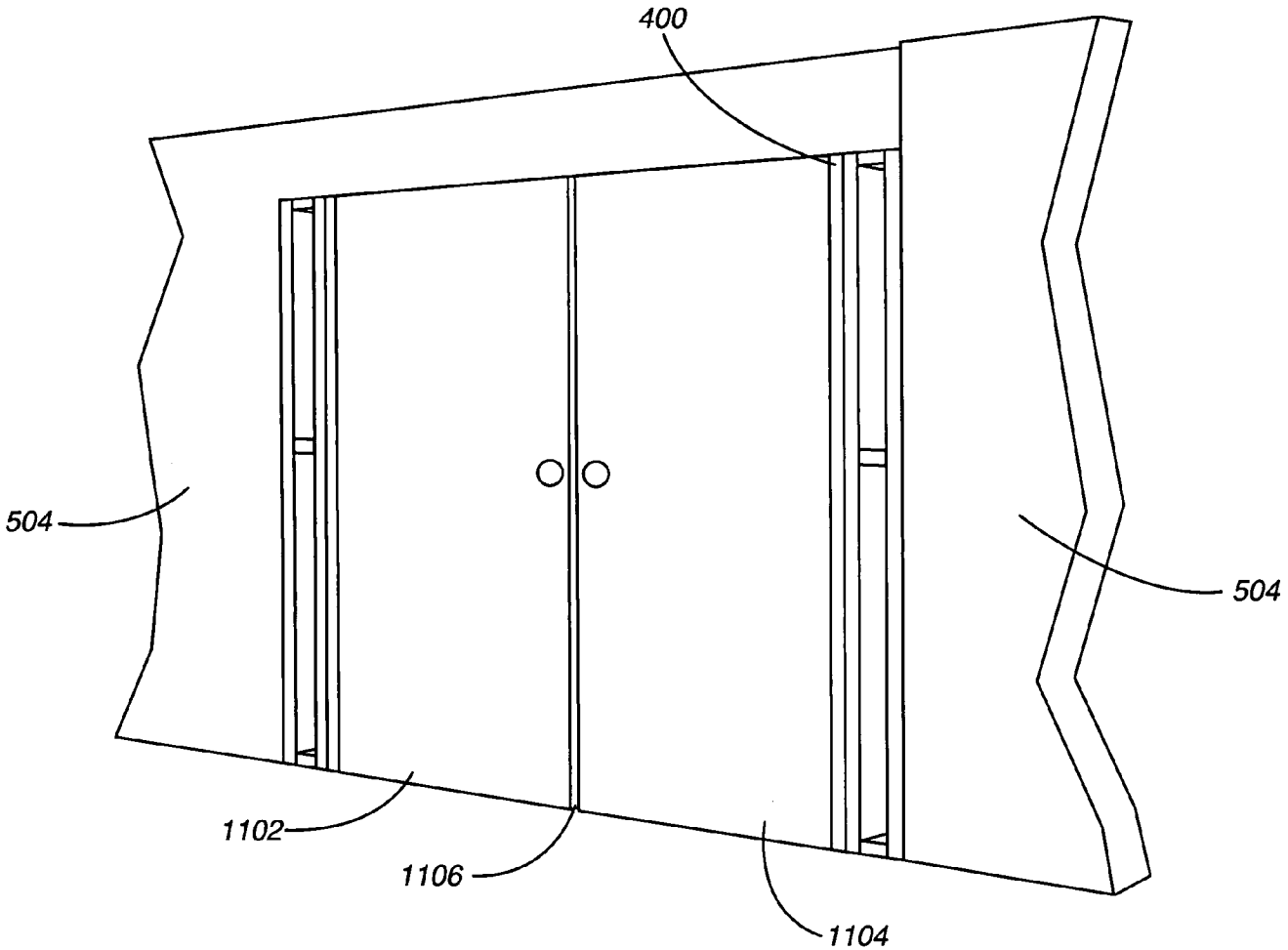
FIG. 11 is a diagram illustrating double doors and a frame mounted in a rough opening in a wall.

FIG. 11 shows a double set of doors 1102 and 1104. It is even more important that the doorframe 400 be accurately aligned when installing double doors. Not only is it important, as in a single door, that the doors have an even spacing between the sides and top of the door and the wall 504, but also the doors 1102 and 1104 must match up properly with each other. Any skew in the frame 400 will cause the space 1106 between the doors 1102 and 1104 to be non-uniform.

An additional function of the clamping pairs can be seen in FIG. 12. In FIG. 12, a gap 1202 is shown between stud 506 and frame section 406. The clamping pair 132 and 134 can be extended beyond the frame section 406 to take up the gap 1202 and physically contact the stud 506. In this manner, the clamping pair 132 and 143 works to secure the device 100 and frame 400 within the opening 502 until the frame 400 can be permanently secured with nails or screws.

Figure 14:
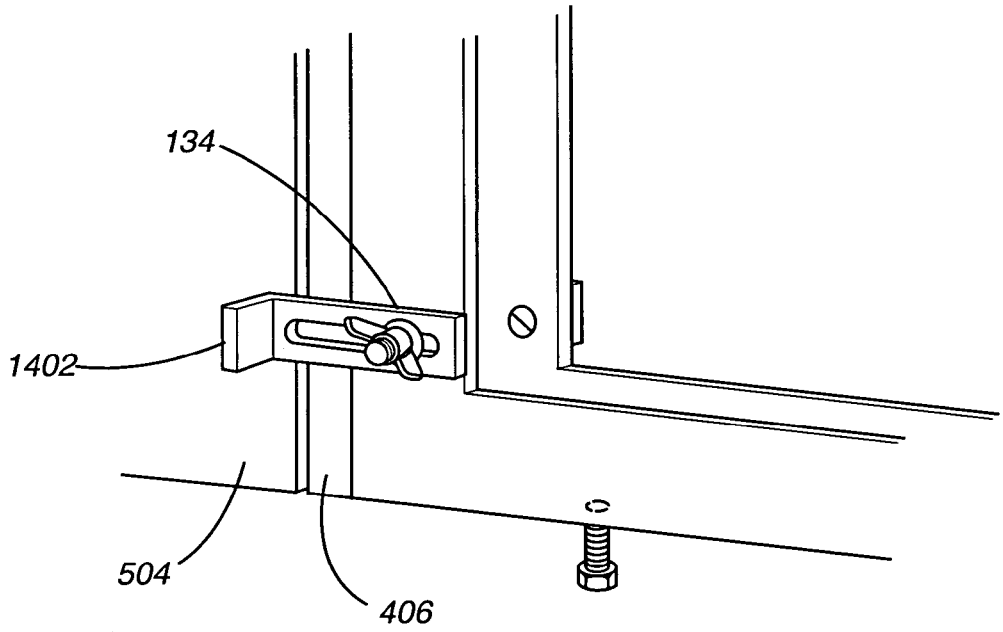
FIG. 14 is a diagram illustrating a close-up view of a section of a doorframe-hanging device, including a doorframe, adjustable foot, and a second embodiment of a clamping pair.
Figure 15:
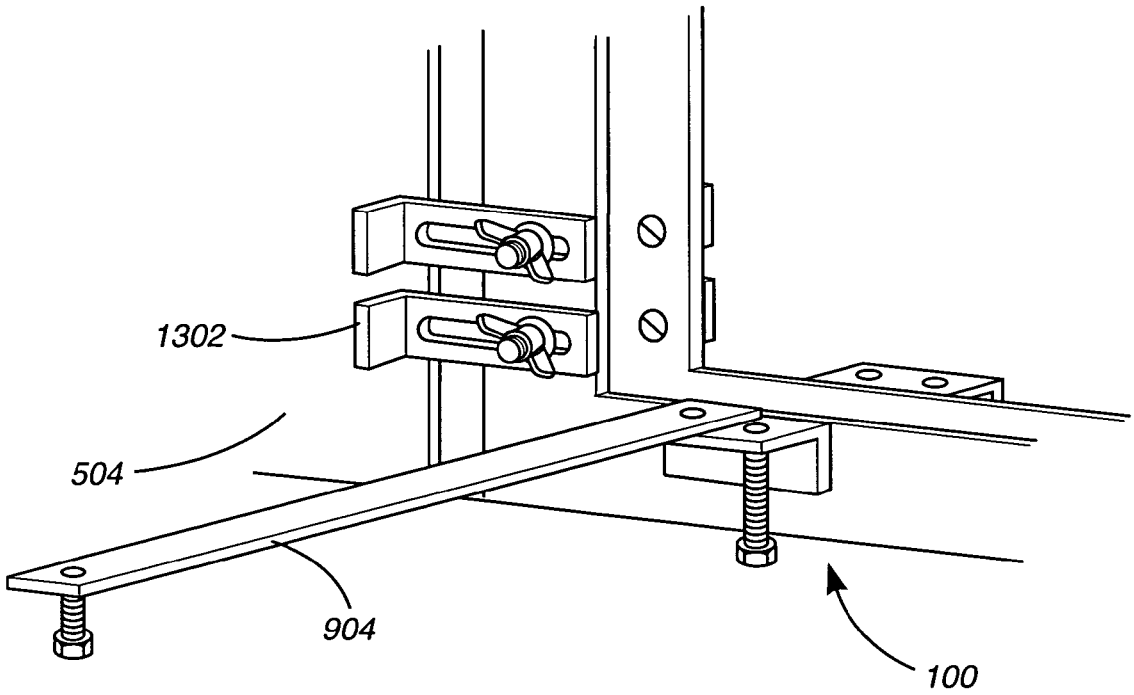
FIG. 15 is a diagram illustrating a close-up view of a section of a doorframe-hanging device, including a doorframe, adjustable feet, a lever-arm assembly, and a second embodiment of a first and second clamping pair.

An alternative use of clamping pairs 132, 134, 136, 138, 140, 142, 144, 146, 148, 150, 152, and 154 is shown in FIGS. 14 and 15, where a finished wall 504 is shown. A finished wall is any wall with a framework of studs covered with a material such as sheet rock, plywood, wallboard, or other similar materials to provide a relatively smooth surface and hide the studs. In FIGS. 14 and 15, clamp 134 is turned over so that an L-shaped portion 1402 of clamp 134 faces away from the wall 504. As can be seen in the drawing, clamp 134 extends beyond frame section 406 and contacts the wall 504. When used in this manner, the clamps ensure that the device 100, and therefore the frame 400 share the same plane as the wall 504.

FIG. 15 shows an embodiment of the present device 100 with the lever arm 904 and an additional clamp 1302 turned in the reverse direction, as described in the preceding paragraph. The additional clamp 1302 provides added stability and additional contact surface area for the wall 504.

Figure 16:
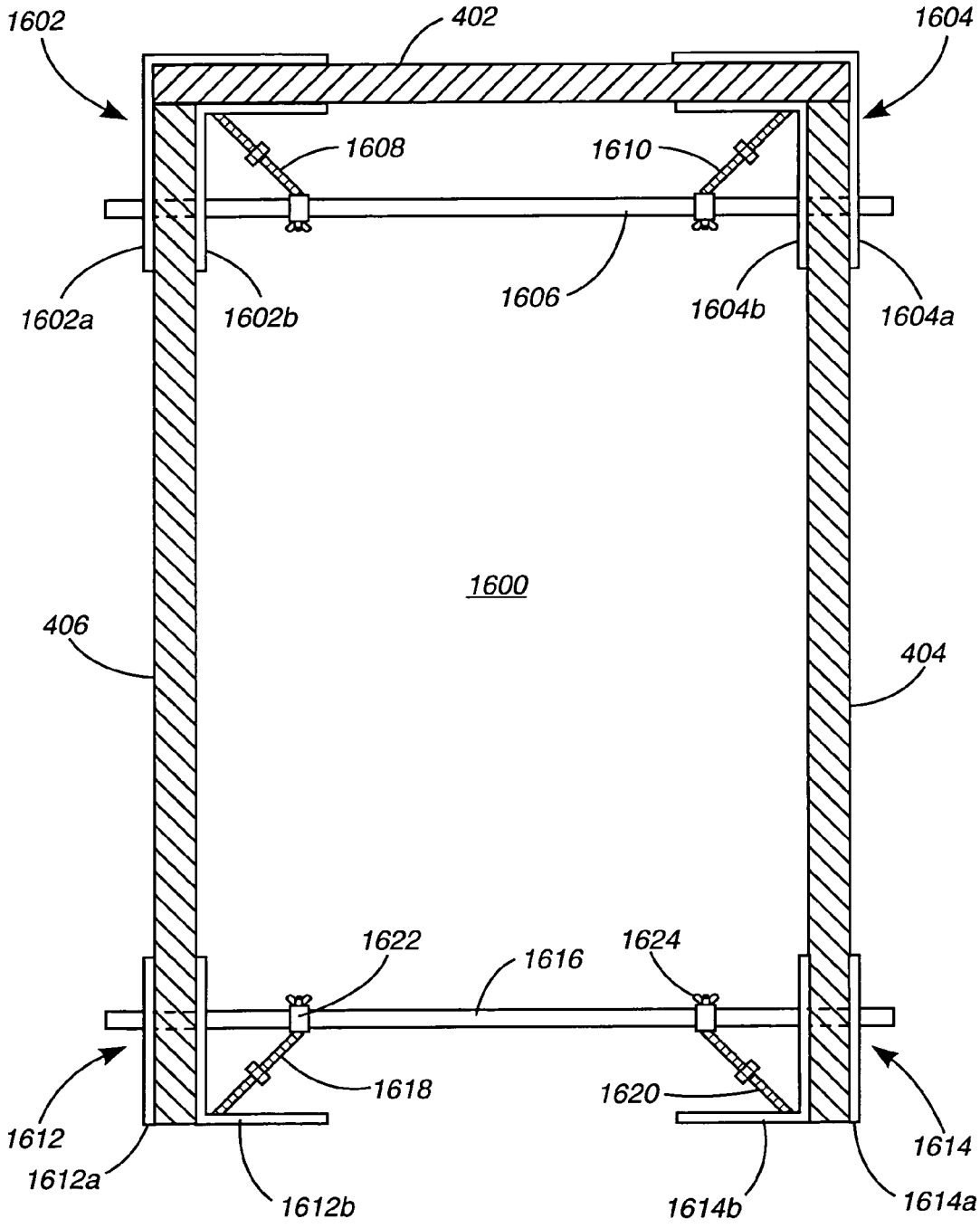
FIG. 16 is a diagram illustrating one embodiment of a doorframe-hanging device.

One alternative embodiment of the present invention is shown in FIG. 16. The door installation device 1600 includes two upper corner brackets 1602 and 1604, each having an L-shaped outer section 1602*a*, 1604*a* and an L-shaped inner section 1602*b*, 1604*b*. The L-shaped outer 1602*a*, 1604*a* and inner 1602*b*, 1604*b* sections are used to sandwich two portions (406 and 402 in bracket 1602 and 404 and 402 in bracket 1604) of the doorframe 400 sections and hold them at an approximately 90-degree angle. A bar 1606 passes through outer 1602*a*, 1604*a* and inner 1602*b*, 1604*b* sections of the brackets 1602 and 1604. The bar 1606 further includes two devices 1608 and 1610 disposed on opposing sides of the bar 1606, which function as positioners and tensioners for the inner sections 1602*b* and 1604*b*. The tensioners are slidably, releasably affixed to bar 1606 and permanently affixed to the inner sections 1602*b* and 1604*b*. In this manner, the upper corner brackets 1602 and 1604 can accommodate frames of varying sizes.

The embodiment shown in FIG. 16 further includes two lower corner brackets 1612 and 1614. Each lower corner bracket 1612 and 1614 includes an outer section 1612*a* and 1614*a* and an L-shaped inner section 1612*b* and 1612*b*. The outer 1612*a*, 1614*a* and inner 1612*b*, 1614*b* sections are used to sandwich a side 406 and 404, respectively, of the doorframe 400 and hold them at an approximately 90-degree angle to the floor surface 512. A second bar 1616 passes through outer 1612*a*, 1614*a* and inner 1612*b*, 1614*b* sections of the brackets 1612 and 1614. The second bar 1616, like the first bar 1606, further includes two devices 1618 and 1620 disposed on opposing sides of the bar 1616, which function as positioners and tensioners for the inner sections 1612*b* and 1614*b*. The tensioners are slidably, releasably affixed to bar 1616 and permanently affixed to the inner sections 1612*b* and 1614*b*. In this manner, the lower corner brackets 1612 and 1614 can accommodate frame sections of varying dimensions.

In one embodiment, the outer sections 1602*a*, 1604*a*, 1612*a*, and 1614*a* are permanently fixed to the bars 1606 and 1616. The inner sections 1602*b*, 1604*b*, 1612*b*, and 1614*b* are not fixed on the bars 1606 and 1616. Each of the four tensioning devices 1608, 1610, 1618, and 1620 is connected at one side to each of the inner sections 1602*b*, 1604*b*, 1612*b*, and 1614*b* and has a sliding collar 1622 containing the bar 1606 or 1616 at the opposite side. Each collar 1622 has a tightening screw 1624 that passes through the collar 1622 and contacts the bar 1606 or 1616. The collar 1622 is provided with threads so that when tightening screw 1624 is turned, pressure is placed on the bar 1606 and 1616 to secure the collar 1622, and in turn, the entire tensioning device 1608, 1610, 1618, and 1620 in its position.

Additionally, the portions of bars 1606 and 1616 that extend beyond the outer sections 1602*a*, 1604*a*, 1612*a*, and 1614*a* butt up against the wall 504 when the device 1600 is fully inserted into a rough opening in a wall. The bars 1606 and 1616, therefore, serve at least three functions: 1) to align the corner brackets; 2) to provide tensioning support for the inner portions 602*b*, 1604*b*, 1612*b*, and 1614*b*; and 3) to align the frame with the plane of the wall 504.

Figure 17:
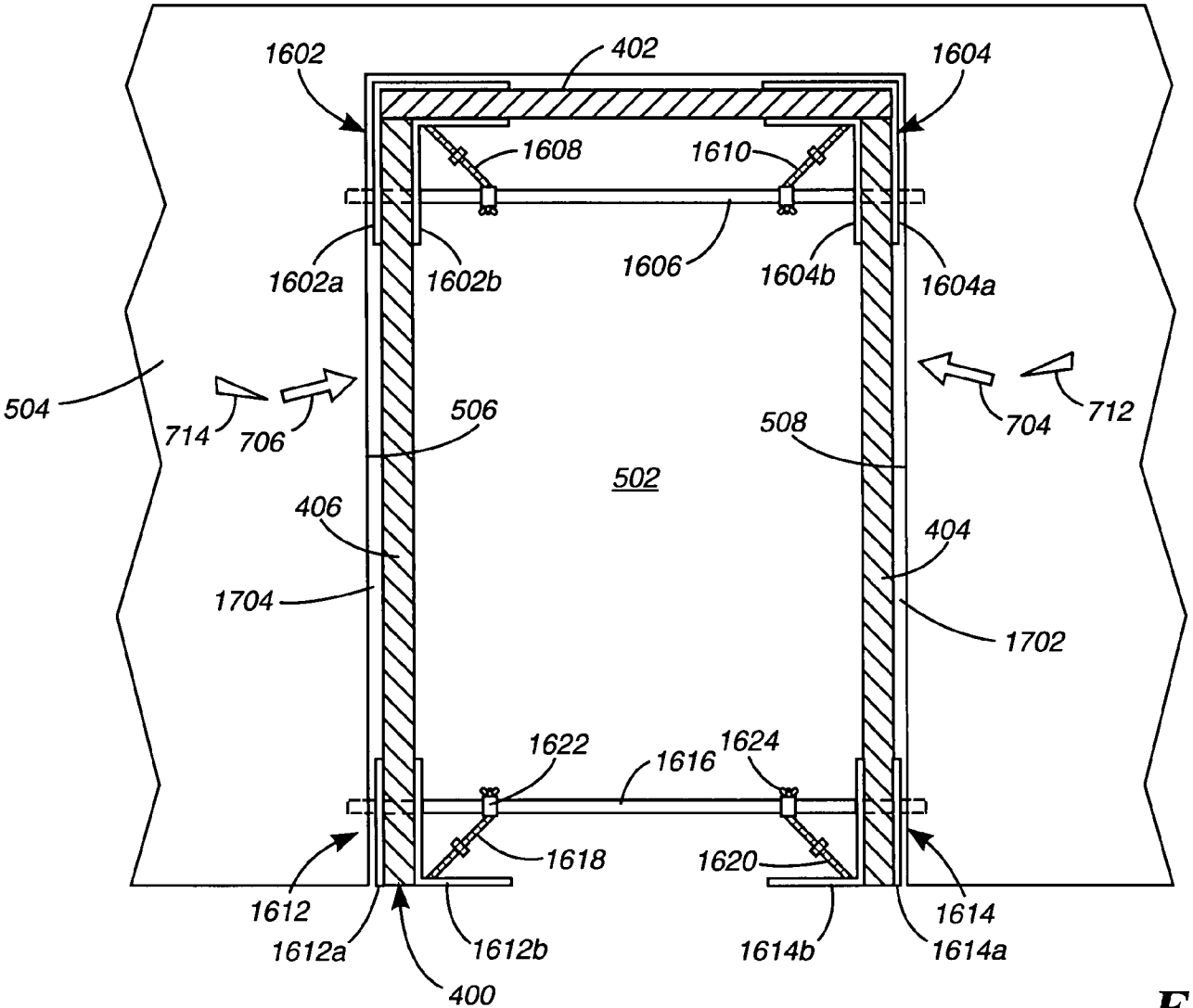
FIG. 17 is a diagram illustrating one embodiment of a doorframe-hanging device located inside a rough opening in a wall.

As with the installation methods so far described, the rough opening 502, formed by studs 506 and 508, header 510 and floor 512, is slightly larger than the outer dimension of the frame 400. Shim material 712 and 714 is placed between the frame 400 and vertical studs 506 and 508 defining the rough opening 502. As can be seen in FIG. 17, the outer sections 1602*a*, 1604*a*, 1612*a*, and 1614*a* of the corner brackets 1602, 1604, 1612, and 1614 are located between the vertical studs 506 and 508 and header 510. The shims 714 and 712 allow the frame to be installed while gap 1702 and 1704 remains between the sides of the frame 400 and the studs 506 and 508. This gap 1702 and 1704 allows the outer sections 1602*a*, 1604*a*, 1612*a*, and 1614*a* of the corner brackets 1602, 1604, 1612, and 1614 to be removed once the frame 400 is securely attached to the opening 502 in the wall 504 and the tensioners 1608, 1610, 1618 and 1620 are released.

The embodiment just described and shown in FIGS. 16 and 17 provides the advantage of having less material and therefore, a low total weight and ease of storage when not in use, while also being able to maintain the doorframe in its proper orientation and alignment during installation in a rough opening in a wall.

In each of the embodiments shown and described, the shims 710, 712, 714, 716 and any gaps between the frame 400 and the rough opening in the wall 502 can be concealed by placing a cosmetic cover, commonly referred to as a "case molding," around the edges of the doorframe. The final step of installing the case molding gives the perfectly aligned doors a clean, professional appearance.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims.

What is claimed is:

1. A doorframe installation device comprising:

a first, a second, a third, and a fourth slidably adjustable element arranged in a rectangular configuration, forming a rectangular pass-through opening approximately the size of a doorway and being slidably adjustable in a height dimension and a width dimension of the rectangle;

at least one clamp attached to at least one of the expandable elements for securing a section of a doorframe to the at least one expandable element;

at least one adjustable foot attached to at least one of the expandable elements for providing a distance from a floor surface to the door installation device; and wherein the slidably adjustable elements further comprises at least two channel members slidably joined together by at least one linkage plate whereby the two channels include inwardly disposed wall elements forming an inwardly facing U-shaped channel.

2. A doorframe installation device comprising:

a first, a second, a third, and a fourth slidably adjustable element arranged in a rectangular configuration, forming a rectangular pass-through opening approximately the size of a doorway and being slidably adjustable in a height dimension and a width dimension of the rectangle;

at least one clamp attached to at least one of the expandable elements for securing a section of a doorframe to the at least one expandable element;

at least one adjustable foot attached to at least one of the expandable elements for providing a distance from a floor surface to the door installation device; and a plurality of holes in at least one of the elements for driving a screw or nail into an inward facing surface of a door opening.

3. The doorframe installation device according to claim 2, further comprising at least one clamp attached to each of the first and second slidably adjustable elements for securing a first side section of a doorframe to the first slidably adjustable element and a second side section of the doorframe to the second slidably adjustable element.

4. The doorframe installation device according to claim 2, further comprising at least one clamp attached to the third slidably adjustable element for securing a top section of the doorframe to the third slidably adjustable element in a position approximately perpendicular to the side sections of the doorframe.

5. The doorframe installation device according to claim 2, wherein each of the elements further comprises:

a first section;

a second section;

an inwardly extending member disposed on the first section;

an inwardly extending member disposed on the second section;

a plate with a linear groove containing the members; and a retainer on each of the inwardly extending members to secure the members at a location within the groove.

6. The doorframe installation device according to claim 2, further comprising the elements being formed of one of plastic, wood, composite, and metal.

7. The doorframe installation device according to claim 2, wherein the adjustable feet are telescoping.

8. The doorframe installation device according to claim 2, wherein the at least one clamp comprises:

a body with a first section and a second section attached to the first section in an L-shaped configuration, and a hole in the first section for containing a section of a bolt for attachment to the door installation device.

9. The doorframe installation device according to claim 2, further comprising:

at least one lever arm with a first end and second end, an adjustable foot attached to the first end, and the second end pivotally attached to at least one of the slidably adjustable elements.

10. A door installation device comprising:

a first and second corner bracket, the first and second bracket each including:

an L-shaped outer section; and an L-shaped inner section;

a bar connecting the first and second corner brackets; and a set of tensioning devices located on the bar for positioning and applying pressure to each of the L-shaped inner sections;

wherein each of the tensioning devices comprises a first end with a sliding collar containing the bar; and a second end connected to at least one of the inner sections.

11. The doorframe installation device according to claim 10, wherein the corner brackets further comprise:

the outer section of the first section and the outer section of the second section being fixedly attached to the bar connecting the first and second corner brackets.

12. The doorframe installation device according to claim 10, further comprising:

a third and fourth corner bracket, the third and fourth corner bracket each including:

an outer section; and an L-shaped inner section;

a bar connecting the third and fourth corner brackets; and a set of tensioning devices located on the bar connecting the third and fourth corner brackets, for positioning and applying pressure to the L-shaped inner sections of the third and fourth corner brackets.

13. The doorframe installation device according to claim 12, wherein the corner brackets further comprise:

the outer section of the third section and the outer section of the fourth section being fixedly attached to the bar connecting the third and fourth corner brackets.

* * * * *